United States Patent [19]

Samuelson

[11] 4,439,271

[45] Mar. 27, 1984

[54] PROCESS FOR THE OXYGEN BLEACHING OF CELLULOSE PULP

[75] Inventor: Hans O. Samuelson, Gothenberg, Sweden

[73] Assignee: Mo och Domsjo Aktiebolag, Ornskoldsvik, Sweden

[21] Appl. No.: 270,438

[22] Filed: Jun. 4, 1981

[30] Foreign Application Priority Data

Jun. 5, 1980 [SE] Sweden ..... 8004184

[51] Int. Cl.[3] ..... D21C 3/02; D21C 9/00

[52] U.S. Cl. ..... 162/19; 162/65; 162/81

[58] Field of Search ..... 162/63, 81, 65, 19, 162/76

[56] References Cited

U.S. PATENT DOCUMENTS 4,076,579 2/1978 Brink ..... 162/63

4,087,318 5/1978 Samuelson et al. ..... 162/65

FOREIGN PATENT DOCUMENTS 419593 3/1974 U.S.S.R. ..... 162/65

OTHER PUBLICATIONS

Clarke, "The Action of Nitrogen Dioxide on Unbleached Pulp, Part I", *TAPPI,* Feb. 24, 1944, pp. 62–66.

Casey; "Pulp and Paper, 2nd Ed., vol. I"; Interscience Pub.; N.Y.; 1960, pp. 456–457.

*Primary Examiner*—Steve Alvo

[57] ABSTRACT

A two-stage oxygen bleaching of chemical cellulose pulp is provided, in which an alkaline oxygen bleaching stage is preceded by a nitrogen dioxide activating stage in which oxygen is added to the activating stage in an amount such that nitrogen monoxide formed as an intermediate during the activation process is consumed, so regulating the amount of oxygen added that when the activation reaction is practically complete, substantially all of the nitrogen dioxide and nitrogen monoxide has been consumed.

29 Claims, No Drawings

PROCESS FOR THE OXYGEN BLEACHING OF CELLULOSE PULP

In order to delignify chemical cellulose pulp without or with a much-reduced amount of chlorine-containing bleaching agent, it has been recognized that one can prior to an oxygen gas bleaching stage bring the pulp into contact with a gas phase containing nitrogen dioxide, whereby the lignin is activated. In doing this, however, one ends up with a third of the reactive nitrogen dioxide reduced to nitrogen monoxide, which shows itself surprisingly inactive at atmospheric pressure and up to considerably elevated temperatures.

In the delignification of cellulose pulp by alkaline oxygen gas bleaching the pulp is impregnated with sodium hydroxide, and is then treated with oxygen gas under pressure at a temperature of about 100° C. for normally about thirty minutes. Magnesium compounds are added in order to protect the carbohydrates against excessive degradation. Despite this, the delignification can only be carried to a stage where about 50% of the lignin remaining in the pulp after the digestion process has been removed. After that, the degradation of the carbohydrates becomes so great as to seriously impair the strength properties of the pulp.

In the case of sulfate pulp produced from softwood, such as pine, the pulp at the start of the oxygen gas bleaching has a lignin content corresponding to a Kappa number of from about 30 to about 40, which is reduced to from about 15 to about 20 during the delignification. The remaining lignin has to be removed by treating the pulp with chlorine, alkali and chlorine dioxide.

It is well known that chlorine-containing bleaching agents give rise to chlorinated aromatic substances and bio-accumulatable chlorinated substances during the bleaching. If these are discharged with waste bleaching liquor into streams and lakes, they are taken up by fish. These substances cannot be destroyed by biological purification of the sewage water. Some chlorinated byproduct substances have been found to be mutagens.

Consequently, disposal of chlorine-containing waste bleaching liquor from bleaching plants constitutes a very serious problem. Efforts have been made to reduce the use of free or elementary chlorine in the bleaching of cellulose pulp by use of chlorine dioxide instead. The production of chlorine dioxide requires about three times as much electrical energy per kilogram of active chlorine as elementary chlorine.

Nitrogen dioxide has been proposed as a substitute for chlorine in the bleaching delignification of cellulose pulp, and has been studied by Clarke (*Paper Trade Journal, Tappi. Sect.* 118 62 (1944)). However, in those methods where nitrogen dioxide has been tested, carbohydrates in the pulp have been degraded to such an extent as to preclude its use.

The delignification of lignocellulosic material by treatment with nitrogen dioxide, followed by washing with water, treatment with alkali, and subsequent treatment with oxygen gas, has also been proposed in Swedish patent application No. 77 05136-5. However, this technique has not been put into commercial practice.

Another proposal which has not come into practice has been made in Swedish patent application No. 75 06646-4. This bleaching process includes the steps of (1) treating the cellulosic material with a blend of nitrogen monoxide and nitrogen dioxide with nitrogen monoxide in a molar excess, (2) washing with water and (3) then treating with alkali, for example, in the presence of oxygen gas, under superatmospheric pressure. The nitrogen dioxide can optionally be generated in situ from nitrogen monoxide and oxygen, in which case the nitrogen monoxide is added in an excess of four times the added molar amount of oxygen. The reaction proceeds under superatmospheric pressure with respect to nitrogen monoxide, for example, 7 kp/cm$^2$ is shown in Example 1. The nitrogen oxides are removed by depressurizing, followed by evacuation. In every Example, a superatmospheric pressure is employed in the handling of the nitrogen oxides. The handling problems remain, with a great risk of injury to both the internal and external surroundings, and a high consumption of nitrogen oxides.

In summary, the pretreatment of cellulose pulp with nitrogen dioxide $NO_2$ before an oxygen gas bleaching makes possible a more complete delignification and an improved oxygen gas bleaching, without deterioration in the paper-making properties of the pulp. The patent literature indicates that nitrogen monoxide NO gives a like effect. From the reports of the results, it appears that a superatmospheric pressure of nitrogen oxide is necessary, however. A common drawback for the previously-described processes in which pulp, before an oxygen gas bleaching, is treated with some of these nitric acid precursors is that these remain present in a significant amount at the conclusion of the process. Safeguarding against these gases and rendering them innocuous give rise to the cost, the losses, and the various environmental problems.

In accordance with the present invention, these difficulties are avoided by carrying out the activation stage with nitrogen dioxide gas in the presence of oxygen gas in an amount such that nitrogen monoxide formed as an intermediate is consumed while regulating the amount of oxygen gas that is added in such a manner that at the conclusion of the activation stage, practically all of the nitrogen monoxide and nitrogen dioxide have been consumed.

The invention accordingly provides a process for the treatment of cellulose pulp with nitrogen dioxide $NO_2$ adapted for application before an oxygen gas bleaching to make possible a more complete delignification and an improved oxygen gas bleaching, without deterioration in the paper-making properties of the pulp, which comprises subjecting the cellulose pulp to an activation reaction with nitrogen dioxide gas in the presence of water and pure oxygen gas in an amount within the range from about 0.1 to about 5 moles per mole of $NO_2$ and in an amount within the range from about 0.6 to about 5 moles per mole of NO, so that nitrogen monoxide formed in the activation is utilized in the activation reaction.

The invention also provides a process for the delignification of cellulose pulp, including chemical pulp prepared from the digestion of lignocellulosic material, which comprises bringing the cellulose pulp in an activation stage in the presence of water and in contact with a gas phase containing nitrogen dioxide and modifying the lignin content of the cellulose pulp by reaction with nitrogen dioxide; adding oxygen gas to the activating reaction in an amount within the range from about 0.1 to about 5 moles per mole of $NO_2$ and in an amount within the range from about 0.5 to about 5 moles per mole of NO, so that nitrogen monoxide formed in the activation is utilized in the activation reaction; and then in a second stage, subjecting the pulp to an oxygen gas bleaching in the presence of an alkaline-reacting neutralization medium or neutralizing agent.

The process of the invention is applicable to any cellulose pulp, but especially chemical cellulose pulp prepared using an akaline pulping liquor. Examples of alkaline chemical pulps include sulfate pulp, polysulfide pulp and soda pulp. In the soda pulp group are included pulps digested with sodium hydroxide as well as other alkaline materials, in the presence of the usual additives. Examples of additives include redox catalysts, such as anthraquinone. The process is also applicable to other chemical pulps, such as, for example, sulfite pulp.

The process in the activation stage is carried out in such a way that a substantial amount of nitrogen monoxide formed as an intermediate, for example, from 20 to 50 mole percent based on the amount of nitrogen dioxide added, is consumed in the activation, and at the same time, under such mild conditions that the nitrogen monoxide that is formed does not enter into direct reaction with the cellulose pulp in the absence of the oxygen gas.

The oxygen gas is added in a sufficient amount to activate nitrogen monoxide formed as an intermediate so that it is utilized, and is at the same time rendered innocuous.

Under selected conditions, ther reactions with the cellulose pulp proceed very quickly. How the reactions proceed has not been made entirely clear. The nitrogen dioxide and nitrogen monoxide have a tendency to form dimers and possibly higher polymers and addition complexes with each other and with other components. These products quickly transform themselves into others, and the equilibria are changed according to pressure and temperature. Nitrogen dioxide can form $N_2O_4$ and other forms of polymers. One mole of $N_2O_4$ corresponds to 2 moles of $NO_2$. Addition products containing NO are calculated in the same manner as NO. Nitrogen sesquioxide $N_2O_3$ is in equilibrium with both nitrogen monoxide NO and nitrogen dioxide $NO_2$:

$$N_2O_3 \rightleftharpoons NO + NO_2$$

and is thus calculated as 1 mole of NO + 1 mole of $NO_2$. Addition products with oxygen gas also can form. The reaction schemes are complicated even in the absence of cellulose pulp.

All that can be said regarding the reactions during the activation is that the cellulose pulp is brought into contact with the gas phase containing nitrogen dioxide and the amount of oxygen gas added is so regulated that at the conclusion of the activation stage practically all of the NO and $NO_2$ have been consumed. Preferably, the amount remaining of the total nitrogen oxides $NO_2$+NO is less than 1 mole percent of the total amount of these oxides added in the gas phase. With a practically complete consumption of the nitrogen oxides, at least 99% of the added amount of $NO_2$+NO has been removed from the gas phase. Other nonidentified nitrogen compounds that possibly may be present in small amounts of the gas phase are not taken into account.

By selecting an appropriate amount of oxygen gas, reaction time and reaction temperature, one can make certain that the amount consumed of $NO_2$ and NO can be brought to 99.9% at the end of the activation stage. One can determine these by experiments on a small scale in the laboratory, and then extrapolate from these to the large scale required for carrying out the process in a mill, in order to make certain that the danger to the environment can be eliminated.

The first stage of the two-stage process of the invention has been referred to here as an activation stage. This is correct insofar as the two-stage process normally leads to a quick delignification in the following oxygen gas bleaching stage. It can however be said that the term "deactivation" is more relevant, under certain conditions. Under these conditions, the strongest effect is that the pulp behaves as though it were deactivated, in such a manner that the degradation of the carbohydrates during oxygen gas bleaching, which is a kind of cellulose depolymerization, becomes much slower than normal. Probably the dominating effect is indirect, and does not occur from reactions between nitrogen dioxide and/or nitrogen monoxide and the carbohydrates.

Pure oxygen gas is added to the activation stage. Liquid oxygen can be used, and this can be added directly and optionally in advance to the reactor in which the activating process is to be carried out.

The amount of oxygen that is added to the activation stage should be at least 0.05 mole calculated as $O_2$ per mole of $NO_2$ added. In many cases a larger amount, desirably within the range from 0.1 to 5 moles of oxygen per mole of $NO_2$ added, can be used for an improved result. Best results have been obtained by an addition within the range of from 0.15 to 0.30 moles of oxygen per added mole of $NO_2$.

Because pure oxygen gas is added, and the amount added is within these limits, the amount of residual gas is very small at the conclusion of the process.

$NO_2$ in liquid form is a product of commerce that can be added to the process in this form. Desirably, the nitrogen dioxide can be added to the reactor before or at the same time as the oxygen used in the activation stage. The nitrogen dioxide can instead be generated in situ by oxidation of nitrogen monoxide with oxygen. For the preparation of nitrogen oxide, one can with advantage employ the catalytic combustion of ammonia; the resulting reaction mixture can be fed directly to the activation stage and used as such. In this way, the chemical costs can be lowered.

The gas phase containing nitrogen dioxide can be prepared by reaction between oxygen gas and nitrogen monoxide before or during the activation stage. Based on the added moles of nitrogen monoxide, the total amount of added oxygen is at least 0.55 mole, desirably from 0.6 to 5 moles, and preferably 0.65 to 0.80 mole, so that both the added and the intermediate nitrogen monoxide formed is utilized for the activation process, and so that at the conclusion of the activation stage practically all of the nitrogen dioxide and of the nitrogen monoxide are consumed.

One can also add a blend of nitrogen oxide and nitrogen dioxide to the activation stage. In this case, the amount of oxygen that is added has to be adjusted accordingly. The amount of nitrogen dioxide and nitrogen monoxide added to the process totals within the range from about 3 to about 300 gram moles based on each 100 kg dry weight of the cellulose pulp.

Usually a satisfactory amount for most pulp types is within the range from about 10 to about 150 gram moles per 100 kg of cellulose pulp. Cellulose pulp from coniferous wood or softwood is cooked for so long a time that the defibration is complete without mechanical disintegration. For example, in the case of cooking to a Kappa number of from 20 to 40, the preferred amounts are within the range from about 30 to about 100 gram moles calculated for each 100 kg dry weight of cellulose pulp. In the case of other pulps, the amounts lie within these ranges, selected with consideration for the environment and cost.

It has been noted that a very good result is obtained if the cellulose pulp is subjected to a reduced pressure or evacuated before bringing it into contact with the gas phase containing nitrogen dioxide in the reactor, the activation process then being carried out on the cellulose pulp in that reactor. In a preferred embodiment, the total pressure during the activation process either in whole or in part is maintained below atmospheric. This is particularly desirable when the process is carried out at a low temperature, for example, within the range from 0° to 50° C. A particularly good delignification is obtained, while adding a low amount of nitrogen dioxide and/or nitrogen monoxide.

In contrast to the teachings of Swedish patent application No. 75 06646-4, it is particularly advantageous to hold the partial pressure of nitrogen monoxide during the activating process at a low level, suitably below 0.5 bar, and preferably below 0.2 bar. Particularly favorable results are obtained when the highest partial pressure of nitrogen monoxide during the process does not exceed 0.1 bar.

A considerable advantage in the process of the invention, as compared to earlier methods, is that the reaction rates for the different reactions in the activation stage are conveniently controlled by adding at least one of the gaseous reaction components under controlled conditions in the course of the activating process. In this way, one can bring about a uniform reaction throughout the entire cellulose pulp mass, although the chemical reactions proceed very rapidly.

In working on a batch operation, it is suitable that the nitrogen dioxide, for example in the form of liquid nitrogen dioxide, be added over a fixed time interval, for example, five minutes, and at the same time add the major part or the entire amount of the oxygen as pure oxygen gas in gaseous form. The oxygen gas can also be present in the reactor before the addition of nitrogen dioxide and/or nitrogen oxide. The addition of oxygen gas can also be made after the addition of nitrogen dioxide and/or nitrogen oxide is complete. It is also possible to begin addition of the oxygen first, and then a large part of the added nitrogen dioxide has been consumed.

In working in a continuous process, desirably the gaseous components are added continuously to a continuous flow of cellulose pulp at a selected point along the length of the reactor, so that one obtains an optimum uniform distribution throughout all parts of the pulp that is undergoing reaction. Introduction of one or of several gas components at several locations can also be adopted, for a better distribution, without increasing the total reaction time. For control of the activation stage, it is suitable that a proportion of the nitrogen dioxide and/or nitrogen monoxide be continuously added to the gas phase at a stage where the reaction between nitrogen dioxide and the cellulose pulp proceeds, and that the oxygen gas addition to the process is controlled in such a way that the nitrogen dioxide and nitrogen monoxide are practically fully consumed at the end of the activation stage.

If one adds slowly to the reaction mixture at least one of the gas components, particularly oxygen, to provide for a moderated reaction, it is suitable that one provide an intimate contact between the gas and the cellulose pulp by vigorous mixing of the pulp, and dispersing and possibly finely-dividing the gas through the pulp.

The temperatures in the activation stage are suitably within the range from about 0° to about 100° C. Higher temperatures can be used if the amount of nitrogen dioxide plus nitrogen monoxide is low, and/or the reaction time is short, for example, less than five minutes, or even shorter, for example, less than one minute. A longer reaction time, for example, from five to twenty minutes, can be used, provided the temperature is correspondingly low, for example, within the range from 0° to about 70° C., preferably from 20° to 50° C., when there is a great need to remove nitrogen oxides effectively. It is advantageous to start the activation process, for example, at 20° C., and let the temperature rise, for example, by from 30° to 50° C., in the course of the process. If one works with a low addition of nitrogen dioxide plus nitrogen monoxide, the reaction time can be lengthened correspondingly.

A high pulp concentration during the activation stage, for example, from 25 to 50%, or higher, for example 60%, makes possible a uniform reaction in a simple apparatus, in which the pulp is brought preferably in fluff form into contact with the gas phase. The pulp should not be added in dry form. A pulp concentration below 25% can nevertheless be used, and one can in this case find it easier to handle the pulp before the activation stage.

If one has a low pulp concentration, for example, within the range from 6 to 20%, it can be very suitable to distribute the gas phase into the pulp with vigorous mechanical blending, for example, in blenders of the disintegrator type, or in an apparatus which simultaneously imparts a pumping effect, and/or an effective mixing of the gas phase into the pulp in the form of small bubbles.

Known apparatus for oxygen gas bleaching with pulp of comparable consistency can be used in the activation stage. In this case, the gas addition suitably can be partly at the beginning of the process and partly after the reactions have proceeded to a suitable stage.

The pulp is preferably activated over a reaction time of from 5 to 250 seconds. When working at high temperatures, for example, temperatures in the region of 80° to 100° C., the reaction time is preferably short, and does not exceed 250 seconds. When working at lower temperatures, a reaction time longer than 250 seconds can be used, for example, from 5 to 30 minutes, before the soluble reaction products formed in the activating stage are washed out.

After the activation stage, the pulp is washed, suitably with water and/or an aqueous solution. If the washing is omitted, the consumption of alkaline neutralization medium in the following oxygen gas bleaching stage is greatly increased. Instead of water, or particularly after a water wash, it is advantageous to treat the pulp with an alkaline-reacting solution, for example bleaching liquor.

In accordance with a preferred embodiment, the cellulose pulp after the activation stage is washed with water and/or an aqueous solution under such conditions that an acid solution results, which can be used to wash pulp after cooking, preferably after displacing cooking liquor with liquor from some oxygen bleaching stage.

Whenever the pulp after the activation stage is washed with water or with an aqueous solution, so that an acid solution results, or a similar washing, it is desirable to treat the pulp with an alkaline-reacting solution, suitably at from about 20° to about 100° C., preferably at from 40° to 80° C. As such solution there can be used waste liquor from oxygen gas bleaching, for example, from the oxygen gas stage of the present invention, either entirely or in part. In this way, a part of the modified lignin is extracted out of the activated pulp.

It is suitable that a part of the resulting extracting liquor be recirculated to the extraction stage, or added for washing in another part of the system, for example, for displacement of cooking liquor. A part of the liquor from the extraction stage can with advantage accompany the pulp to the oxygen gas bleaching stage.

In similar manner, either at the beginning and/or particularly before the oxygen gas bleaching stage, the pulp is impregnated with an alkaline reacting neutralization medium, and possibly other known additives, such as, for example, magnesium compounds, complexing agents, formaldehyde, and/or phenylene diamine.

Despite the fact that the oxygen gas bleaching waste liquor contains many organic compounds which form complexes with divalent or trivalent metal ions, such as calcium, magnesium, manganese, copper and iron, present in the system, it has been found suitable to introduce to the pulp one or more additional chelating or complexing agents for transition metals, such as aminopolyphosphonic acids, aminopolycarboxylic acids, or other complexing agents which are not produced in the process prior to and/or during the oxygen gas stage. The introduction of complexing agents in conjunction with the oxygen gas bleaching delignification stage is often carried out in a manner such that the complexing agent and the chelates or complex metal compounds formed thereby are present during the oxygen gas bleaching delignification. In the case of pulps studied hitherto it has been found more advantageous to use complexing agents which are not produced in the process in accordance with the method of the invention to remove any complexed transition metal compounds by filtration and/or washing, prior to the oxygen gas bleaching delignification stage. Even when these complex compounds are removed prior to the oxygen gas bleaching delignification stage, it may be justified to subsequently add thereto further complexing agents so that a suitable complexing agent concentration is present during the oxygen gas bleaching delignification stage.

Normally, the maximum effect of a small amount of complexing agent, for example 0.1 kg/ton of pulp, is obtained in the method according to the invention when the addition is made in a slightly acid medium during or after the activating stage, preferably after the major part of the waste liquor from the activating stage is removed from the pulp, and any metal complexes that are formed are separated from the pulp prior to the oxygen gas stage.

If the oxygen gas delignification is to be continued to a Kappa number below 6, it is often necessary to add a larger quantity of complexing agents, for example, an amount within the range from about 0.2 to about 1 kg/ton of pulp. Even larger amounts of complexing agents can be employed, provided they are inert to the process. Addition of complexing agents can also suitably be made at other stages in the process, preferably such that complexes of, for example, manganese, are separated from the pulp (including the accompanying liquor) before the pulp enters the oxygen gas reactor vessel, and so that only complexing agents containing ligands not bound to transition metals are present during the oxygen gas delignification stage.

The complexing agent should be supplied to the pulp in solution at a pH below 7.5, suitably below 6, and preferably within the range from about 1 to about 4. The complex-forming reactions can be allowed to proceed for a short period of time, for example, for one minute, although improved selectivity can often be observed when the time for the treatment is extended to, for example, from 30 to 90 minutes. When the treatment is started at a pH of from 1 to 4, it is advantageous to increase the pH to within the range from about 6 to about 9 after a short period, for example, a period which embraces 10% of the total complex-forming reaction time. The complexing process with complexing agents is suitably effected at a temperature within the range from about 20° to about 100° C., preferably from 20° to 60° C. When a low pH is used, for example, a pH of 1 to 3, the time and temperature must be so adjusted that no appreciable reduction in pulp viscosity is obtained.

At least one complexing agent should be added that provides manganese complexes which at a pH 9 have a stability constant which is at least 1000, preferably at least 10,000 times, greater than the corresponding stability constant for any magnesium complexes present.

Particularly advantageous results have been obtained when using complexing agents containing at leat one and preferably three nitrogen atoms, and at least two and preferably five phosphonic acid groups. Suitable compounds have several nitrogen atoms, each of which is bound to two or three methylene groups. Aminomethylenephosphonic acids can be used to advantage. Particularly good results have been obtained when using diethylenetriamine pentamethylene phosphonic acids.

Other groups of complexing agents that can be used are those used in conventional oxygen gas bleaching delignification processes. For example, polyaminopolycarboxylic acids, such as ethylenediamine tetraacetic acid, and preferably diethylenetriamine pentaacetic acid, are quite satisfactory, particularly if the major part of the complexes formed with transition metals are removed prior to the oxygen gas bleaching delignification stage. The complexing agents can be added in the form of free acids or salts, for example, in the form of sodium salts, or magnesium salts.

It is normal procedure in conventional oxygen gas bleaching delignification processes to add magnesium compounds, in order to protect the carbohydrates from excessive degradation. Additions of magnesium compounds are also advantageous when carrying out the process according to the invention, although the activation and pretreatment of the pulp have a substantially greater protective effect. If the pretreatment process is effective, it is possible, without noticeable disadvantage, to omit magnesium compounds, at least when complexing agents are added, as described above.

Selectivity in the process of the present invention is greatly improved by the introduction of complexing agents.

The complexing agents which are added and the complexing agents formed in situ during the treatment of the cellulose pulp influence the process according to the invention in many different ways. Consequently, it has been impossible to establish those reactions which facilitate the extensive delignification of the pulp without seriously affecting the degradation of the cellulose.

While providing the advantages noted above, the complexing agents also have disadvantages, for example, the removal of manganese compounds, which are delignification catalysts, and which are also protectors against cellulose degradation, such as manganese hydroxide. That under certain conditions manganese compounds effectively protect carbohydrates against degradation in oxygen gas bleaching delignification processes is described by Manourcheri and Samuelson, *Svensk Papperstidning* 80 (1977), 381, and International Paper's Swedish patent application No. 76 01935-8.

Despite this, it has been found that the best selectivity in the process of the invention is obtained when the manganese content of the pulp is reduced from the usual amount of from 70 to 150 mg Mn per kg pulp to less than 4 mg per kg (measured in the oxygen gas bleached pulp). Under comparable treatment conditions, selectivity decreases as manganese content of the oxygen gas bleached pulp increases. From the results it cannot be said that the effect is directly proportional to the manganese content. However, when optimizing the process for different starting pulps, it has been found that a marked improvement in selectivity can be obtained when a large quantity of manganese is removed from the pulp at the earliest possible stage of the process.

It is known that formaldehyde reacts with peroxide formed during the oxygen gas bleaching delignification process, to form formate ions and hydrogen gas. This means that, in conventional oxygen gas bleaching delignification processes, reactions between peroxide and transition metal compounds which give rise to free radicals are suppressed. This decreases the depolymerization of the cellulose. Tests have shown that although these disturbing reactions are less apparent in the process of the invention, formaldehyde not only retards the degradation of the cellulose, but also the delignification, although the net result is an improved selectivity. Hence, addition of formaldehyde can be advantageous under certain conditions.

The greatest effect of formaldehyde, using an addition of 0.5%, based on the dry weight of the pulp, has been obtained when the addition is made prior to the oxygen gas bleaching delignification stage. Paraformaldehyde or other known products which produce formaldehyde can be used, as well as formaldehyde. Hydrogen gas is formed as a byproduct, and can be removed from the reactor vessel by, for example, converting the gas catalytically to water, in known manner.

If a pulp with a very low lignin content is desired, this can be achieved by repeating the process of the invention one, two, or more times. When the two-stage process according to the invention is represented by the shorthand code $NO_2+O_2$, such pulp is obtained with the double sequence $NO_2+O_2+NO_2+O_2$. Triple, quadruple and more repeats can be used, if necessary.

Oxygen gas bleaching delignification of the pulp can be carried out at a pulp consistency within the range from about 1 to about 40%, suitably from 8 to 35%, preferably from 27 to 34%.

The total alkali addition can be within the range from about 1 to about 10%, calculated as NaOH, and based on the weight of the pulp. It has been found particularly advantageous to use a low alkali addition in the oxygen gas bleaching delignification stage, for example, an addition in the order of 1.5 and at most 3% NaOH, and to return oxygen gas waste liquor to the oxygen gas stage.

Conveniently, a longer than normal treatment time is used for the oxygen gas bleaching delignification stage, for example, a time within the range from about 60 to about 500 minutes, suitably from 90 to 300 minutes, preferably from 90 to 180 minutes.

The treatment temperature in the oxygen gas bleaching delignification stage is within the range from about 90° to about 135° C., suitably from 100° to 130° C., preferably 100° to 115° C. When formaldehye is added to the system, the preferred temperature is within the range from 115° to 130° C. Despite the fact that formaldehyde has been found to retard delignification during oxygen gas bleaching delignification according to the invention, the treatment time can be shortened somewhat by applying higher temperatures.

The process of the invention makes it possible to lower the Kappa number of the pulp considerably in the bleaching stage by using chemicals which are relatively inexpensive, and which give rise to waste liquors which can be rendered innocuous by burning, which need not be dumped. Combustion of these waste liquors can be integrated with the combustion of the cooking waste liquor, without providing special arrangements for ejecting chloride from the system. Thus, the invention provides a bleaching delignification process using primarily oxygen gas, which is an inexpensive and innocuous bleaching chemical. Since the amount of lignin which remains in the pulp after the treatment in accordance with the invention is low, the amount of chlorine-containing bleaching agent required for finally bleaching the pulp is much lower than in previously known bleaching methods. Consequently, the waste discharges from the pulp manufacturing plant are reduced.

As a starting material in the process of the invention, one can employ a chemical pulp which has been partially delignified with oxygen gas before the activating stage. Also, the cellulose pulps can be subjected to the process in accordance with the invention several times, for example, two or three times, particularly if one wishes to drive the delignification further without the addition of chlorine-containing bleaching agents.

The following Examples in the opinion of the inventor represent preferred embodiments of the invention:

EXAMPLE 1

An unbleached, undried sulfate pulp from pine wood was pressed to a pulp concentraiton of 40%. The Kappa number of the pulp was 29.5, and the viscosity 1195 $dm^3/kg$ according to SCAN. The pulp at a temperature 20° C. was fluffed in a peg shredder and then placed in a cylindrical reactor which was evacuated at the same temperature to a total pressure of 0.04 bar. Over an interval of one minute, into the vessel there was introduced 2 weight percent nitrogen dioxide, based on the dry weight of the pulp. The reactor was then rotated so as to obtain intimate contact between the pulp and the gas phase. Throughout, the temperature was held at 20° C. After an interval of one minute, there was added oxygen in an amount of 0.5 mole $O_2$ per mole of added $NO_2$. The reactor was then rotated for a further three minutes.

Analysis of the gas phase showed that of the total moles of nitrogen monoxide NO plus nitrogen dioxide $NO_2$, there remained in the gas phase less than 1% of the added amount of nitrogen dioxide.

In a Control run with the addition of nitrogen instead of oxygen, but otherwise under identical conditions, gas analysis showed that 28% of the added amount of nitrogen dioxide remained. Lengthening of the reaction time by a factor of ten led to no noticeable diminution in the residual amount of nitrogen dioxide in the gas phase.

After the nitrogen dioxide activation the two pulp batches were washed with water, and then impregnated with an aqueous solution of magnesium sulfate and sodium hydroxide at a 3% pulp concentration. After three minutes time followed by filtering and pressing the pulp, the pulp concentraion of each pulp was brought to 29% Examination of the filtrate from the pulp which had been treated with nitorgen dioxide showed a strong brown color, due to dissolved lignin.

The pressed pulps contained 3% sodium hydroxide and the total amount of magnesium was 0.2%, both calculated on the basis of the dry weight of the pulp. The pulps were bleached with oxygen gas at a temperature of 100° C. for thirty minutes, under a total pressure of 0.8 MPa. The pulps were then washed with water, and dried at 35° C.

The bleached pulp in accordance with the invention had a Kappa number of 13.2 and a viscosity of 1108 $dm^3/kg$ in a pulp yield of 96.2%.

In the Control run with nitrogen gas instead of oxygen gas, the Kappa number was 14.0, and the viscosity 1098 $dm^3/kg$. The pulp yield was 96.2%.

The results show that addition of a certain amount of oxygen gas in the activation step (1) reduced the venting of nitrogen oxides (2) led to utilization of intermediate-formed NO for activation, and (3) gave a pulp having a lower Kappa number and a high viscosity, without noticeable change in total yield.

EXAMPLE 2

An unbleached, undried sulfate pulp from a mill which produced fully bleached pulp from pine wood was centrifuged to a pulp concentration of 42%. The Kappa number of the pulp was 32, and its intrinsic viscosity 1230 $dm^3/kg$. The pulp was disintegrated in a peg shredder at a temperature of 22° C. such that the pulp became fluffed, homogeneous and finely divided. The pulp was then placed in a reactor which was evacuated at the same temperature to a total pressure of 0.05 bar. Over an interval of seven minutes, into the vessel was introduced 2 weight percent $NO_2$ (including $N_2O_4$) based on the dry weight of the pulp. The reactor was rotated so as to bring about an intimate contact between the pulp and the gas phase. During this operation, the temperature was held at 22° C. $NO_2$ was added, in four portions at intervals of one minute. One minute after the first portion of nitrogen dioxide was added, continuous addition of oxygen gas to the reaction mixture was begun, in an even stream. The oxygen addition was continued for four minutes, to a total addition of oxygen of 0.25 mole $O_2$ per mole of added $NO_2$. The reactor was then rotated a further five minutes at room temperature. The amount of residual $NO_2+NO$ remaining in the gas phase was then less than 1% of the total amount of nitrogen dioxide added.

The pulp was washed in water at 30° C., filtered, and then washed on the filter with water at 70° C. It was impregnated with an aqueous solution of magnesium sulfate and sodium hydroxide to a 5% pulp concentration. The pulp as filtered, and pressed to a pulp concentration of 30%. The pressed pulp contained 2% sodium hydroxide and a total amount of magnesium of 0.2%, both calculated on the dry weight of the pulp.

The pulp was then divided into three parts, which were bleached with oxygen gas at 106° C. in separate autoclaves for from 45 to 90 minutes. The total pressure was 0.8 MPa at room temperature. The bleached pulp was then washed with water and dried at 35° C.

The run with a 45 minute oxygen gas bleaching time gave a pulp with a Kappa number of 9.8, and an intrinsic viscosity of 1030 $dm^3/kg$.

The pulp with a 90 minute bleaching time gave a Kappa number of 8.7, and an intrinsic viscosity of 993 $dm^3/kg$.

A Control was run without the addition of oxygen gas in the activating stage, but otherwise under identical conditions. This run gave a pulp with a Kappa number of 10.5, and an intrinsic viscosity of 990 $dm^3/kg$ after 45 minutes, and after 90 minutes the Kappa number was 9.5 and the intrinsic viscosity 949 $dm^3/kg$. The pulp gave off a strong odor of nitrogen oxides.

In a Control run without the $NO_2$ treatment, after a 45 minute bleaching time, the Kappa number was 12.0 and the intrinsic viscosity 888 $dm^3/kg$. After a 90 minute bleaching time, the Kappa number was 9.9 and the intrinsic viscosity 869 $dm^3/kg$.

It is apparent from these results that there is a considerable improvement in the quality of the pulp as a result of the oxygen gas treatment of the activated pulp, as in Example 1. This is shown particularly by the considerable improvement in the viscosity of the pulp.

EXAMPLE 3

This Example was carried out using the same pulp as in Example 1, at 70° C., with an addition of 4% $NO_2$, but otherwise under the same conditions as Example 1.

In the run in accordance with the invention with oxygen addition in the $NO_2$ activating stage, the number of moles of residual $NO+NO_2$ after the activating treatment was less than 1% of the amount added of nitrogen dioxide. The oxygen gas-bleached pulp had a Kappa number of 11.5, and an intrinsic viscosity of 1130 $dm^3/kg$.

In a Control run without the addition of oxygen gas in the activating stage, the amount of residual nitrogen monoxide NO plus nitrogen dioxide $NO_2$ increased to 30% of the amount of nitrogen dioxide added. The Kappa number after oxygen gas bleaching was 13.1, and the intrinsic viscosity 1120 $dm^3kg$.

A separate Control run without the addition of oxygen gas in the activating stage at a reaction time of 60 minutes, showed an insignificant diminution in the amount of $NO+NO_2$ in the gas phase, at the longer contact time with the pulp. At the same time, the viscosity decreased in the course of the activating stage.

The results show that one can add the nitrogen dioxide and activate at a higher temperature without affecting the degree of delignification, and at the same time one can obtain a diminution in the depolymerization of the carbohydrates.

Having regard to the foregoing disclosure, the following is claimed as the inventive and patentable embodiments thereof:

1. A two stage process for the delignification of cellulose pulp, including chemical pulp prepared from the digestion of lignocellulosic material, including an activation stage followed by an oxygen gas bleaching stage, the activation stage leading to a quick delignification in the oxygen gas bleaching stage, and also to a deactivation of the pulp in such a manner that degradation of the carbohydrates during the oxygen gas bleaching stage becomes slower, which comprises bringing the cellulose pulp in the activation stage in the presence of water in contact with a gas phase containing nitrogen dioxide and modifying the lignin content of the cellulose pulp to increase the rate of delignification in the oxygen gas bleaching stage by reaction with nitrogen dioxide over a reaction time within the range from about 5 seconds to about 30 minutes; adding oxygen gas to the activating reaction in an amount within the range from about 0.1 to about 5 moles per mole of $NO_2$ and in an amount within the range from about 0.6 to about 5 moles per mole of NO, nitrogen monoxide formed in the activation being utilized in the activation reaction; and then in the oxygen gas bleaching stage, subjecting the pulp to an oxygen gas bleaching in the presence of an alkaline-reacting neutralization medium or neutralizing agent, thereby obtaining an increased rate of delignification and a reduced degradation of the carbohydrates during the oxygen gas bleaching.

2. A process according to claim 1 in which the total amount of nitrogen dioxide during activation is within the range from about 3 to about 300 gram moles calculated per 100 kg of dry cellulose pulp.

3. A process according to claim 1 in which the total pressure during the activation is maintained below atmospheric pressure.

4. A process according to claim 1 in which the partial pressure of nitrogen oxide during the activation is maintained beneath 0.5 bar.

5. A process according to claim 1 in which at least one compound selected from the group consisting of oxygen, nitrogen dioxide and nitrogen monoxide is added continuously in the course of the activation reaction to provide a uniform distribution throughout the whole of the cellulose pulp.

6. A process according to claim 1 in which the cellulose pulp is chemical cellulose pulp prepared using an alkaline pulping liquor.

7. A process according to claim 6 in which the chemical pulp is selected from the group consisting of sulfate pulp, polysulfide pulp and soda pulp.

8. A process according to claim 1 in which the cellulose pulp is sulfite pulp.

9. A process according to claim 1 in which after the activation stage, the pulp is washed with water or an aqueous solution before addition of alkaline neutralization medium in the oxygen gas bleaching stage.

10. A process according to claim 9 in which the aqueous solution is oxygen gas bleaching liquor.

11. A process according to claim 9 in which the cellulose pulp after the activation stage is washed with water or an aqueous solution under such conditions that an acid solution results.

12. A process according to claim 11 in which the washed pulp is treated with an alkaline-reacting solution at from about 20° to about 100° C.

13. A process according to claim 12 in which the solution is waste liquor from oxygen gas bleaching, and a part of the modified lignin is extracted out of the activated pulp.

14. A process according to claim 1 in which before the oxygen gas bleaching stage, the pulp is impregnated with an alkaline-reacting neutralization medium.

15. A process according to claim 14 in which at least one additive selected from the group consisting of magnesium compounds, complexing agents, formaldehyde, and phenylene diamine is present during the oxygen gas bleaching.

16. A process according to claim 15 in which the complexing agent is selected from the group consisting of aminopolyphosphonic acids and aminopolycarboxylic acids.

17. A process according to claim 15 in which a complexing agent is added and then any complexed transition metal compounds removed prior to the oxygen gas bleaching delignification stage.

18. A process according to claim 17 in which another complexing agent is added so that a complexing agent is present during the oxygen gas bleaching delignification stage.

19. A process according to claim 15 in which a complexing agent is added, in an amount within the range from about 0.2 to about 1 kg/ton of pulp.

20. A process according to claim 19 in which the complexing agent is supplied to the pulp in solution at a pH below 7.5, and the complex-forming reactions allowed to proceed for a time of up to ninety minutes.

21. A process according to claim 19 in which at least one complexing agent is added that provides manganese complexes which at a pH 9 have a stability constant which is at least 1000 times greater than the corresponding stability constant for any magnesium complexes present.

22. A process according to claim 15 in which formaldehyde is added in an amount of at least 0.5%, based on the dry weight of the pulp.

23. A process according to claim 1 in which the process is repeated at least once.

24. A process according to claim 1 in which the pulp consistency is within the range from about 2 to about 40%.

25. A process according to claim 1 in which the total alkali addition during the oxygen gas bleaching delignification is within the range from about 1 to about 10%.

26. A process according to claim 1 in which the treatment time for the oxygen gas bleaching delignification stage is within the range from about 60 to about 500 minutes at a temperature within the range from about 90° to about 135° C.

27. A process according to claim 1 in which the temperature during the activation is maintained within the range from about 0° to about 100° C.

28. A process according to claim 27 in which temperature during the activation is maintained within the range from 80° to 100° C. and the reaction time does not exceed 250 seconds.

29. A process according to claim 27 in which temperature during the activation is maintained below 80° C. and the reaction times is within the range from 5 to 30 minutes.

* * * * *